US009934710B1

(12) United States Patent
Daneshvar

(10) Patent No.: US 9,934,710 B1
(45) Date of Patent: Apr. 3, 2018

(54) DANESHVAR'S ADVERTIZING MEANS AND METHODS

(75) Inventor: Yousef Daneshvar, WestBloomfield, MI (US)

(73) Assignee: AMERICAN MEDICAL CORPORATION, W. Bloomfield, MI (US)

( * ) Notice: Subject to any disclaimer, the term of this patent is extended or adjusted under 35 U.S.C. 154(b) by 1744 days.

(21) Appl. No.: 12/807,257

(22) Filed: Sep. 2, 2010

(51) Int. Cl.
*G09F 21/04* (2006.01)
*E04H 12/32* (2006.01)
*G09F 17/00* (2006.01)

(52) U.S. Cl.
CPC ..... *G09F 21/04* (2013.01); *E04H 12/32* (2013.01); *G09F 21/048* (2013.01); *G09F 17/00* (2013.01); *G09F 2017/0075* (2013.01)

(58) Field of Classification Search
CPC .. G09F 21/04; G09F 17/00; G09F 2017/0075; G09F 21/048; G09F 2017/005
USPC ..... 40/757, 651
See application file for complete search history.

(56) References Cited

U.S. PATENT DOCUMENTS 3,802,103 A * 4/1974 Neff ..... 40/591
3,815,412 A * 6/1974 Keim ..... 73/170.03
4,519,153 A * 5/1985 Moon et al. ..... 40/591
4,974,355 A * 12/1990 Abrams ..... 40/591
5,255,464 A * 10/1993 Marecek ..... 40/591
5,279,250 A * 1/1994 Palermo et al. ..... 116/174
6,298,590 B1 * 10/2001 Levinson ..... 40/591
6,918,200 B2 * 7/2005 Pena ..... 40/591
7,331,131 B2 * 2/2008 Staples ..... 40/413
2003/0200690 A1 * 10/2003 Galloway ..... 40/779
2004/0003526 A1 * 1/2004 Brooks et al. ..... 40/591
(Continued)

*Primary Examiner* — Shin H Kim

(57) ABSTRACT

Advertising is an important part of communication in a Society. People simply wish to inform others about the information they have and want to spread. At present many techniques are used for doing so. One of such methods is to place the information on the top of the cars or to attach to the cars, such as a bumper sticks. However, this method has a disadvantage, that the process of attachment to the top of the cars is difficult and needs hardware which are expensive, also there is another problem, when a flat sheet of information is attached to the sides of the holding means on the top of the car it would resist against the movement of the air and waste the energy of the moving car. The bumper sticks have their own problems, since they could not be removed or exchanged easily, for such reasons, alternative means would be beneficial. The methods and means, introduced in this application, has the advantage, that first, they can be attached to the cars, very easily, by simply placing parts of the units inside the car and closing the windows or the trunk of the car. Second, these units have the advantages which they will fly like a kite thus the unit will not resist against the movement of the air and would not waste energy. Third, in some models this invention will allow information to be placed inside a packet so that it can be exchanged easily without the need to exchange the whole information unit. Also the unit provides ornaments in order to make their use amusing and more attractive. Also the application introduces different models and units so that the job of advertisement to be easier, more versatile, interesting and economical.

14 Claims, 11 Drawing Sheets

(56) References Cited

U.S. PATENT DOCUMENTS

2005/0076823 A1* 4/2005 Sanders ..... 116/173
2005/0252053 A1* 11/2005 Pena ..... 40/591

* cited by examiner

DANESHVAR'S ADVERTIZING MEANS AND METHODS

THE BACK GROUND OF THIS INTERVENTION

Advertising is an important part of communication in a Society. People simply wish to inform others about the information they have and want to spread. At present many techniques are used for doing so. One such methods is placing the information on the top of the cars or to attaching them to the cars, such as a bumper sticks. However, this method has disadvantages, that the process of attachment to the top of the cars is difficult and needs hardware which are expensive, also there is another problem, when a flat sheet of information is attached to the sides of a holding means on the top of the car it would resist against the movement of the air and waste the energy of the moving car. The bumper sticks have their own problems, since they could not be removed or exchanged easily, for such reasons, alternative means would be beneficial. The methods and means, introduced in this application, has the advantage, that first, they can be attached to the cars, very easily, by simply placing special parts of the unit inside the car and closing the windows or the trunk of the car. Second, these units have the advantages which they are able to fly like a kite, thus the unit will not resist against the movement of the air and would not waste the energy. Third, in some models this invention will allow information to be placed inside a pocket so that it can be exchanged easily without the need of exchanging the whole information unit. Also the unit provides ornaments in order to make their use amusing and more attractive.

BRIEF EXPLANATION OF INVENTION

This application introduces means for presentation of advertisement by making them in a sheet and allowing them to be flown like a kite by attaching them to a car by various attachment means such as strings, straps and similar means. The end of the strings or the strap means are attached to a base designed to be placed or attached to the cars easily. The base is attached to a resilient wire, strings or straps means which will hold the information sheet allowing the information sheet to fly like a kite. The information sheet can be a printed material or be made with use of a transparent pocket means, which allows an information sheet to be placed inside it and viewed. This unit also can be posted on the ground, hanged on the walls, attached to the cars or be flown like a kite, by being attached to the car by use of resilient strings or straps.

The main body of this unit can be a sheet of printed material, or it can be a unit which here is referred as "the pocket" and consists of a flat Double-sided pocket which at least one wall of it would be transparent so that the information placed inside the pkt could be visualized from outside: This pocket will be, attached to a resilient string or strap which would be hold securely by placing inside the car, or even outside of the car by being attached to the car. The strings or strap means may be hold stable by using a pad that would be placed inside the trunk or next to the windows of the car. The sheet of information would be placed inside, the pocket thus it can be easily exchanged by removing the first sheet and placement of a second sheet, with a different information. Thus making it possible to use the whole set up with multiple and different information sheets. The information sheets, can be sheets of regular paper printed from computer by use of the computer program and printers which are available in many places and by using various colored papers. The user has the option of making multiple forms of advertisement easily and this is one of the advantages of this invention. The pocket of information may also be attached to a post and being placed on the yard, it can be also posted on the top of the car, or by being attached to the poles on the top of a car, since the pocket can fly due to use of the string it should be able to act like a kite and prevent it from being a resistance against the wind. The pocket of information would be for single use or reusable. It can be attached to a surface, by use of adhesive, or an attachable and detachable means in order to allow this unit to be used. Thus, the materials will not be wasted, making these units economical and environment friendly. Different versions of these units are explained in the text.

DETAILED EXPLANATION OF THE FIGURES

Figure 7:
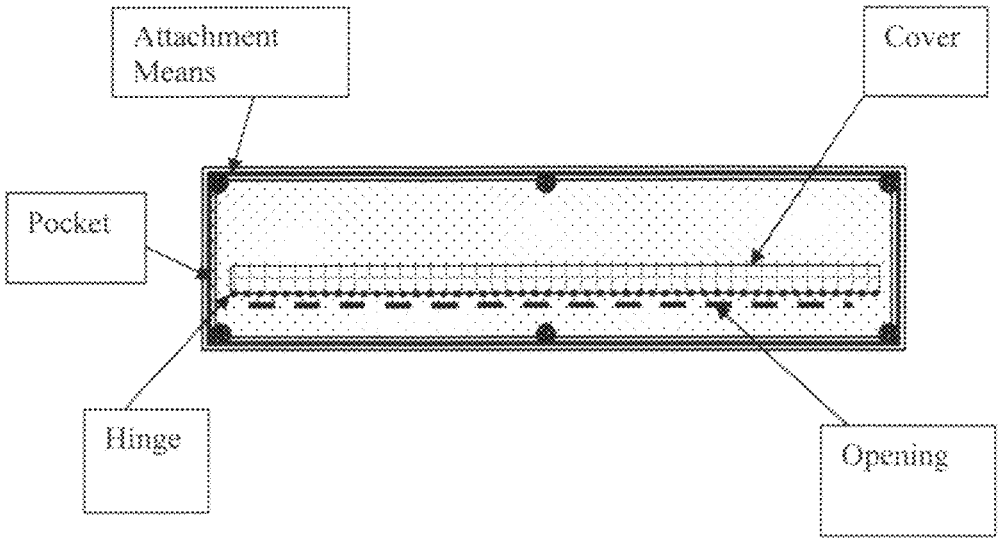
FIG. 7. Shows a modified version of the pocket means shown at FIG. 6. Except in this model the pocket means, has no dividing walls but has a cover FIG. 8. Shows a base, strap means and pocket with connection means and a bar.

FIG. 7 Shows a flat piece, designed for having the advertisement to be printed, on it. This piece may be made from a fabric, a flexible or a rigid material. This flat piece has means of attachment to the string or the strap means. In this model the piece has holes, shown at Hole that allows the strap or the string means to go through and to make it ready for being hanged. The flat piece also has a series of ornaments, Ornament attached to it. So that when this flat piece is airborne the ornaments will fly and make the unit more interesting. These ornaments can be.

1. Pieces of straps of various colors, or straps made with the colors of the flag of the America.
2. They can be pieces of rotating objects which will rotate when they are airborne.

3. They may have any other designs or shapes and purposes.
4. May have lights.

The ornaments will be attached to the main body of the flat piece or they may be attached to the strings and straps or to the car itself.

Figure 1:
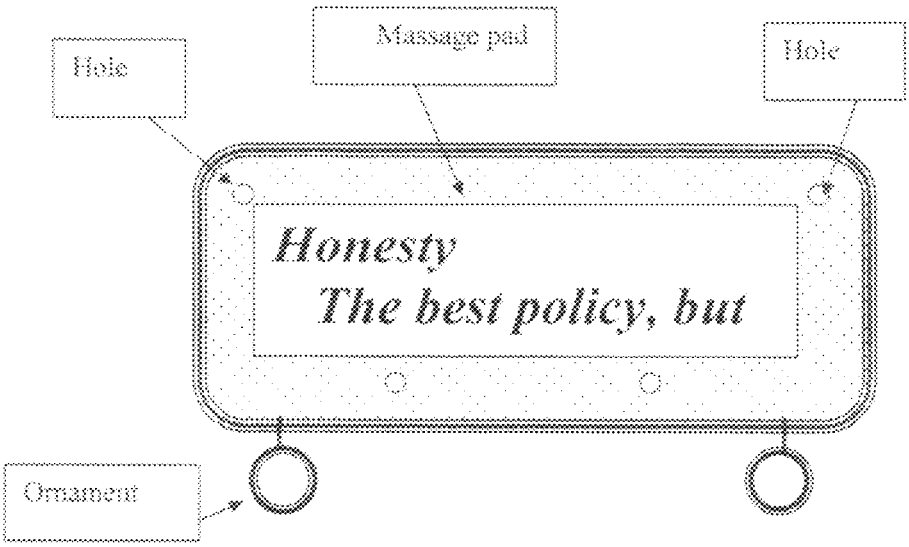
FIG. 1. Shows a flat piece designed for having the advertisement printed, on it.
Figure 2:
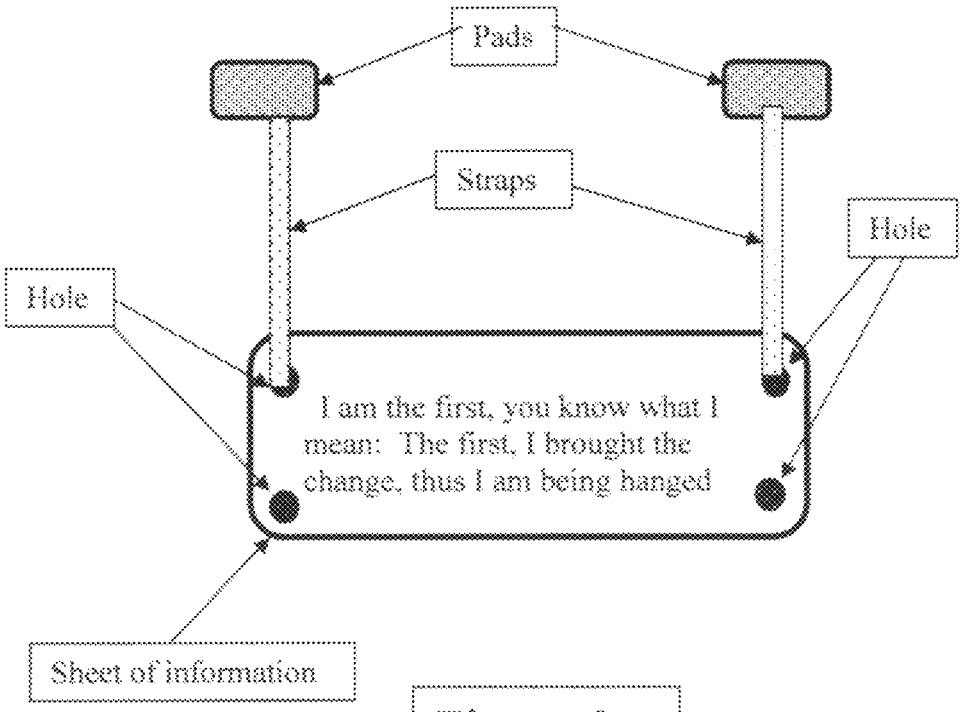
FIG. 2. Shows a flat piece similar to the unit shown at FIG. 1 except this figure also shows the string means attached to it and the pads.

FIG. 2. Shows a flat piece similar to the unit shown at FIG. 1 except this figure also shows a string means and does not show the ornaments. This unit consists of.

I. A flat piece, shown at, Sheet of information which has proper shape, size and has the advertising material printed on it, so that it can be viewed. This piece may be made from fabrics or a flexible or a rigid material of various nature. This flat piece is attached to the strap means, Straps, by use of means of attachment. In this model the piece has holes shown at Hole, that allows a strap or the string means to go through and be tied or snapped in order to make it ready to be hanged. The flat piece may has a series of ornaments attached to it as shown in FIG. 1, so that when this piece is airborne they can fly and make the unit more interesting.

II. The straps are attached to a pad means, Pads, which are simple pieces that will be placed inside the trunk of the car by various means and thus by being fixed inside the trunk or the trunk will be closed and will keep these pads inside, so that it will prevent the straps from being pulled away. Commonly these will be placed inside the trunk of the cars or through be rear doors or windows of the CRV's or station wagons and the doors or windows will be shot closed.

III. The string or strap means, s own at straps, have the least thickness and the needed strength in order to be able to keep the flat piece from being pulled away from the car. They will be resilient so that with the lowest thickness they will be able to endure the pulling and tearing forces and not to breake. Importantly, their thin body will allow them to stand between the body of the car and the closed doors, or in closed trunks, without creating problem.

The string or strap means will be attached to the sheet of information by,

1. Stapling.
2. Gluing
3. By passing a string means or strap through holes in the in the sheet of information and being tied or snapped.
4. Or by any other means.

Importantly, the string, or the strap means are designed to be long enough to allow the flat piece to be airborne but short enough to prevent them from falling to the ground or to being simply too long and inconvenient.

By placing the pads and the ends of the strap means inside the trunk or body of the car the advertising piece could be kept in place sturdy without allowing them to be freed when airborne. Thus this unit provides significant versatility.

Figure 3:
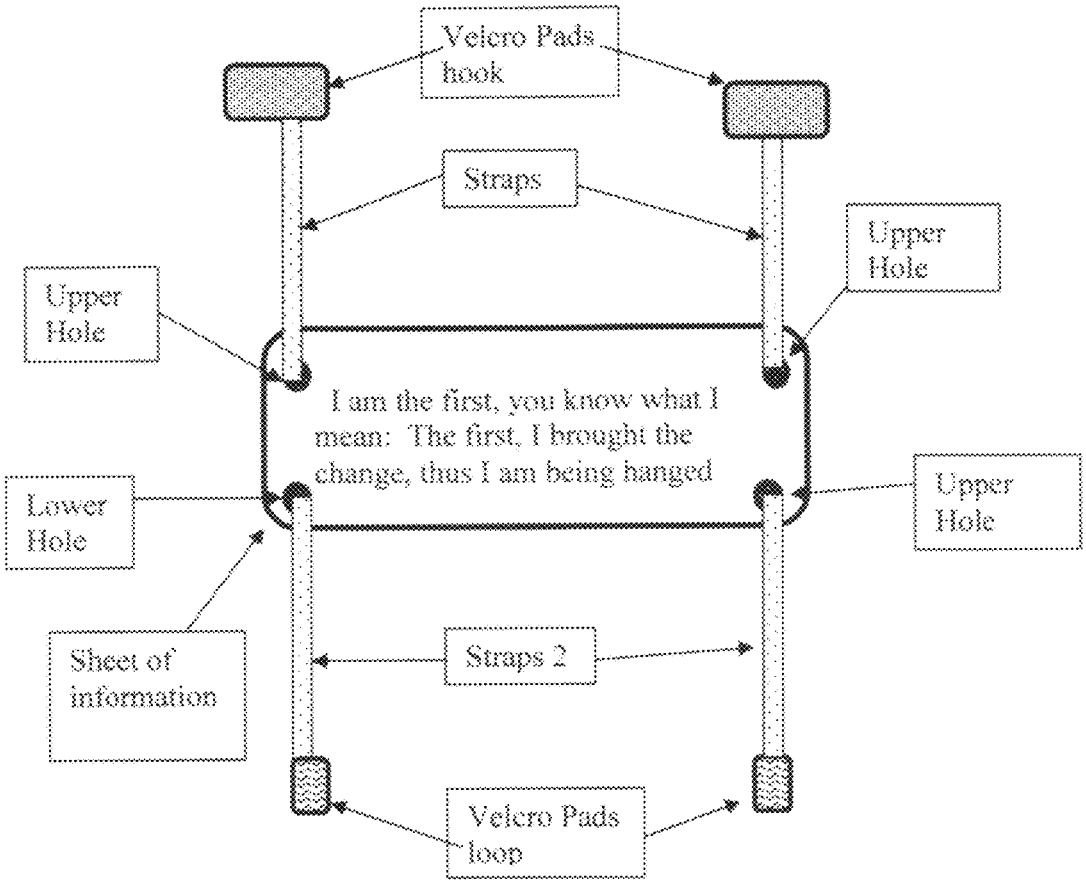
FIG. 3. Shows a unit similar to one shown at FIG. 2 that can be unutilized in slightly different fashion by using a longer strap means so that it can go through the lower holes.

FIG. 3. Shows a method in which a unit similar to one shown at FIG. 2 can be unutilized in slightly different fashion by using a longer strap means so that it can go through the lower holes and then to wrap around part of the vehicle such as the door of the trunk and then by use of attachment means in its end to attach to the base part of the strap, here made from Velcro™ pads. So that this will keep the information sheet securely on the door of the trunk and prevent it from moving. The lower end of this straps means has a matching velcro means that attaches to the base. It should be considered that these attachment can be done by various attachment means. Importantly, this method allows these units to be placed in the sectional doors of trucks to allow the information be seen.

Importantly, in some models the information piece may have attachment means to attach to different parts of the strap means in any spot. One such model may be made by making the strap from the Velcro loop and the attachment means on the information piece from the velcro hook, so that these may be attached in any spot detachably and make the length of the used straps adjustable, this goal may be also achieved by different means using this teaching. This model also shows that in some models the information sheet may be fixed to the autos.

Figure 4:
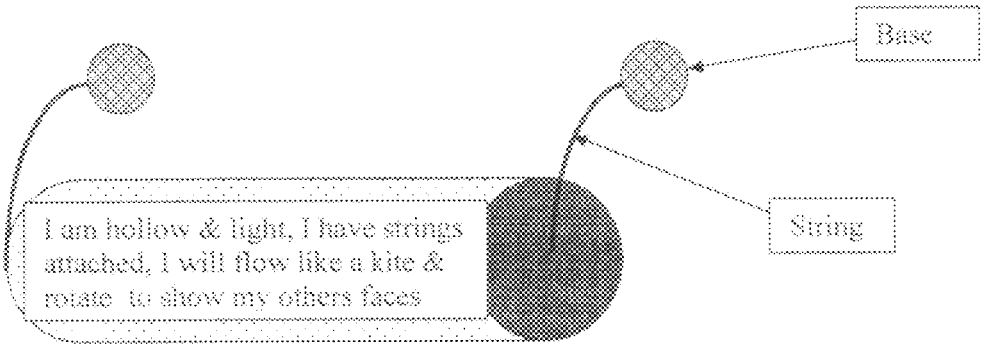
FIG. 4. Shows an information means that has body of a cylinder attached to strings and can be flown.

FIG. 4. Shows even more options of this invention. In this figure the information means has body of a cylinder attached to strings, at the center of its ends and it has pieces, Base, that can be placed inside a car to secure the strings so that the information means can be flown. This figure is chosen to show that the information means may have different and even tridimentional shape and make up, thus it can be like a prism or any other shape and body as well, which gives more options to the users.

Figure 5:
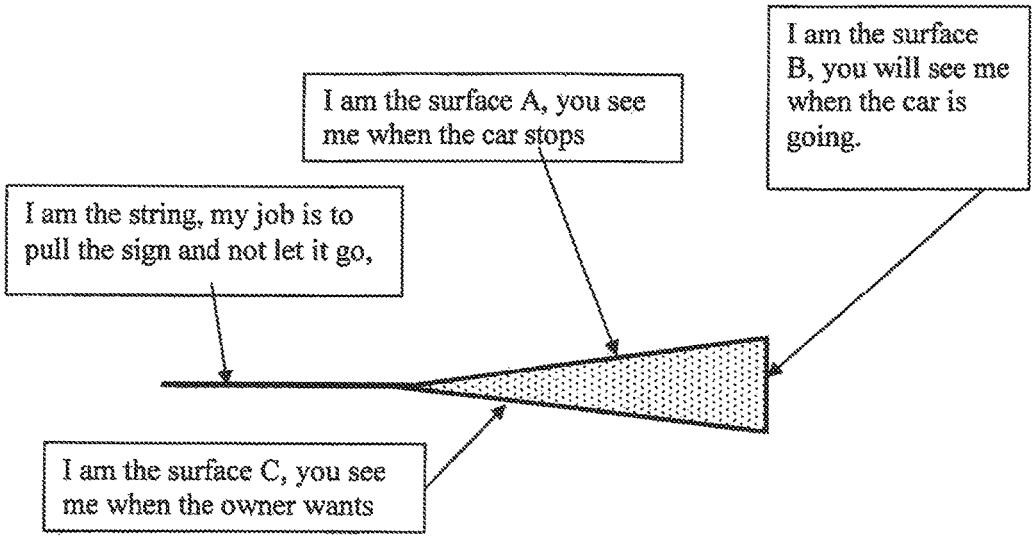
FIG. 5. Shows a three dimensional sign unit with three surfaces.

FIG. 5. Shows an example of other three dimensional unit for this use. This figure shows a cross cut of a sign unit with three surfaces, this unit is like a long, triangular prism. Thus beside the two triangular end sides it has three rectangular surfaces here shown as the surfaces, A, B and C.

Thus the element of changing the signs and using different signs are shown in this figure.

The sign may be made to rotate by hand or various mechanical means.

Figure 6:
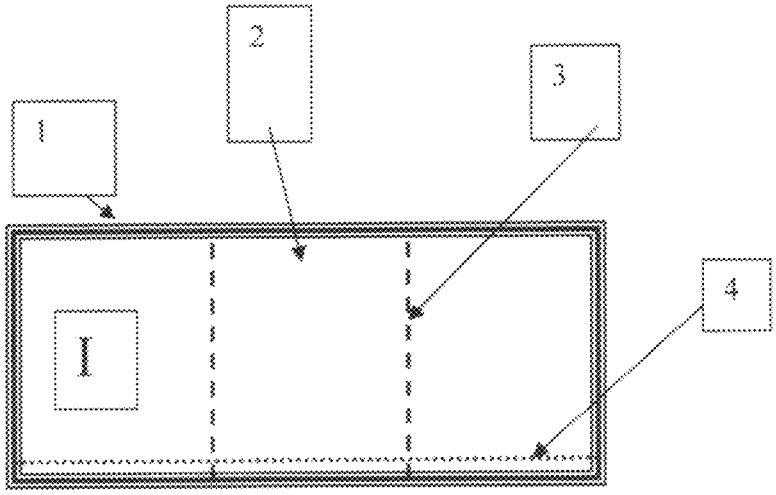
FIG. 6. Shows an envelope means, that allows placement of an information sheet inside. So that the information sheet can be exchanged easily by placing a sheet of information inside this envelope.

FIG. 6. This figure shows an alternative means of presenting the information by this invention. In this model an envelope means, 1 is used for placement of the information. This envelope means allows an information sheet to be exchanged easily by placing a sheet of information inside this envelope. This envelope consist of a flat Double-sided envelope means which has two walls attached to each other in their external borders for making such an envelope or a rectangular pocket. Importantly, at least one wall of this env will be transparent so that the information which is placed inside the envelope could be visualized from outside. The main env may have further deviding walls, one of them shown at 3 which they divided the main body to multiple spaces for placement of multiple special sized sheets of information. In this model there is 3 of such spaces. This model is designed so that each space takes one page standard size paper of 11*8.5 inches, so that the information can be printed easily using the computer and regular printers and to be placed inside these spaces, so that a larger advertise can be made with use of three pieces of regular sheets of papers to make it easy and affordable. Importantly, this method allows the information she is to be changes easily. In the lower side of this figure there is a line of opening or a cut, shown t 4 that allows the sheets of information to placed inside these pockets. This part may hay a cover of its own (shown at FIG. 7) to prevent from dirt and rain to move inside. This envelope will be also attached to the car by strings means attached to it via use of various means explained in this application.

FIG. 7. Shows a modified version of the pocket means shown at FIG. 6. Except in this model the pocket means, Pocket is shown with no dividing walls in it, to prevent from a busy figure however, there is a cover means shown at Cover that is hinged to the body of one of the walls of envelope (can be front or the back) so that the cover will cover the opening, Opening of the envelope and prevents from the dirt and rain or similar to move inside. The hinge is shown at Hinge. This envelope will be attached to the car by strings means attached to it via use of various means explained in this application. Also in this model the attachment means, Attachment means are shown that can be holes or snaps that allows the unit to be attached to the car securely utilizing the attachment means or the string means, or similar. Thus the envelopes allows a sheet of information to be placed inside it and displayed by A. By flying it as a kite, hanged form windows.
B. By flying it like a kite from rear by holding the string means in the trunk of the car.
C. By attaching it to the top of the car by use of bases.
D. Importantly, even they may be taken out and be placed on a post/s on the ground.
E. The pocket means may have attachment means or be adhered to the body of the vehicle in order to allow the information sheet to be changed. This will provide significant advantage that the pocket means would not need to be changed but the information can be changed at will. This model can be even adhered to the bomber of the vehicles.

Figure 8:
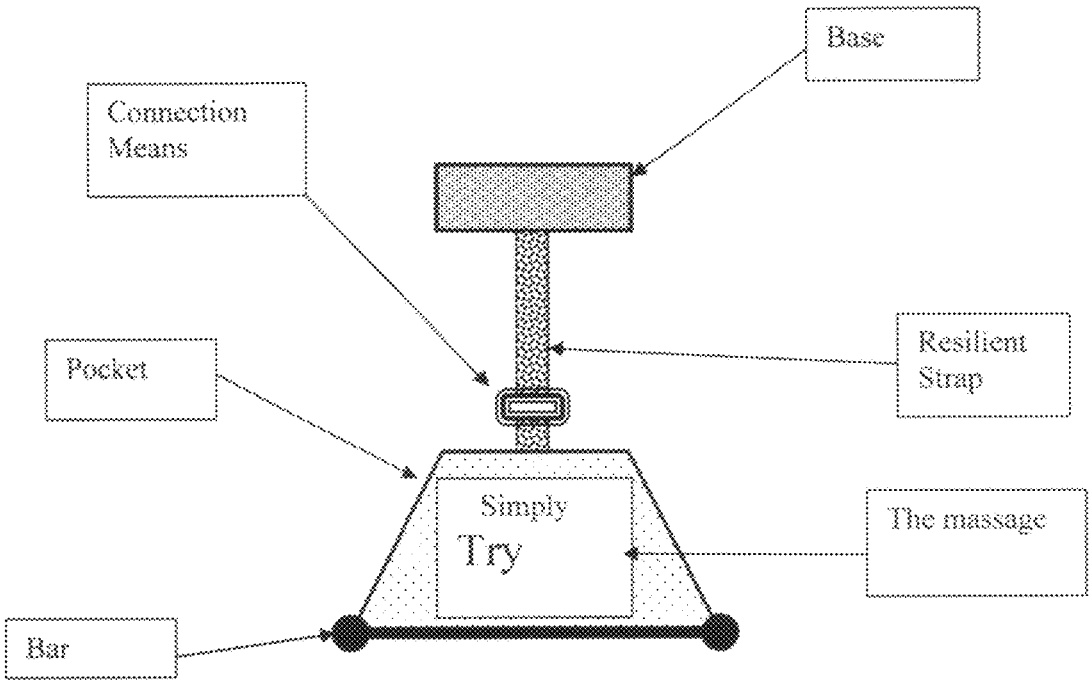

FIG. 8. Shows a modified version of this invention which basically consists of the following.

1. A securing means shown at Base, designed for placement inside the body of the car or inside the trunk for preventing from the release of an attached strings or straps means, shown at Resilient Strap, so that the securing means when in place, can not be pulled away from the space which they are designed to stay. For example, the securing base can be placed inside the trunk of the car so that when the door of the trunk is closed the rest of the string will be out of the trunk and the securing means will not allow the string means to be poled away from the trunk. Or the base, Base may be placed inside the windows again for preventing the string to be pulled away from inside the car. In some models securing base may be attached to the window or placed, outside of the window in order to allow the flat piece to be hanged inside the window.

Securing means, can be

1. A. pad means, or an object so it will stay inside the vehicle or in one side of the body of the vehicle and prevent the string means to be pulled out.
2. A clamp means to clamp to matching part in one side of the body of the vehicle and prevent from the string means being pulled out.
3. A clip means in order to clip to a matching part in one side of the body of the vehicle to prevent from the string means being pulled out.
4. Using a suction means that allows the string means to be attached to the body of the vehicle or the glasses.
5. Piece of wood, plastic or similar means, big enough not to be pulled via the opening of a closed door or trunk of a car.
6. A heavy object to be placed inside the one side of, the body of the vehicle to prevent from the string means being pulled out.
7. Shaped pieces, may be attached, on removable Re: attachable basis 2 parts of the trunk or body of the ventricle.
8. Various attachments means, such as being tied to the hinge means or related parts of the door of the car, or parts of the car in order to prevent the string to be pulled away.
9. Screwing means.
10. Adhesive means, that allows the string means or part of its end means to be attached to the body of the vehicle. Such as attaching a Velcro™ piece to the body of vehicle so that the matching patch of the Velcro™ can be used for attachment and detachment of the string means.
11. Magnetic means.
12. Attachment to the spare tires or their bases.
13. Or any other means that can possibly be used for securing the string, or straps in or outside of the car for this purpose.

Thus the base means is to hold a resilient strings or strap means from moving from one side of the window or inside of the trunk or any other part of the car. Whether closed or open.

2. A resilient strings or strap means, Resilient Strap which would be connected to the envelope, and keeps the envelope from being flown away. The attachment of this drug means to the body of the pocket or designed can be of many kind such as.

a. It may have a clip in order to to through the hole and prevent from the string means to be pulled out of the hole.
b. To be a clamp means, in the other side of the hole of the pockets means in order to prevent from the string means being pulled out and also to allow the length of the string means to be adjusted to shorten or lengthen.
c. The attachment spot of the string means to the pockets means may allow it to be disconnected from the pocket means at will.
d. The attachment point of the string means to the pockets means may allow the pockets means to rotate and allow the different faces of the pockets means to be shown.

Importantly, the string means may have extra pieces or extensions for being fixed in different directions to the string means itself, the pocket means or the sheet of information or the body of the auto or similar in order to allow the pockets means to be hold sturdy in one position compared to body of the car or door of the trunk or similar. This may be needed in some cases which flying or the angle or the degree of flying will not be best due to certain circumstances such as severe winds, different design etc.

3. An envelope means, here shown at Pocket which consist of a flat Double-sided envelope which has two walls attached, to each other in their borders to make such an and envelope or rectangular pocket. Which at least one wall of it would be transparent so that the information placed inside the envelope could be visualized from outside. This envelope will be, attached to a resilient string or strap which would be hold securely by placing inside the car, or even outside of the car by being attached to the car. This pocket means allows a sheet of written material a photo or similar means to be placed inside it, here shown at The massage. One side of this pocket means may have a bar means, shown at Bar which is a rather heavy bar which makes the envelope to fell down after it was air born. A connection means; shown at Connection means allows the resilient strap, Resilient strap to be disconnected and connected from each other in order to remove the pocket, Pocket when there is a need for such connection, for exchange, storage or any other means. to one piece of it.

Figure 9:
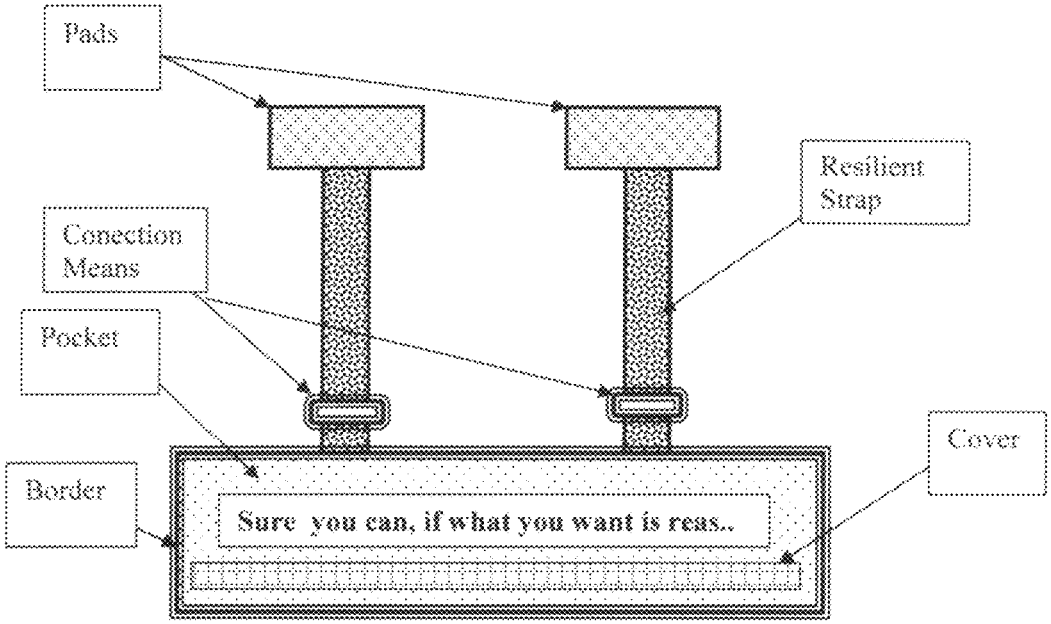
FIG. 9. Shows a unit with two strap means and pads, with a long pocket.

FIG. 9. Shows a modified version of the unit shown at previous FIG. 8. Except this unit has two strap means shown at Resilient Straps with the connection means, Connection Means, attached to them and a rather long pocket, Pocket with its sealed borders shown at Border, and the cover for opening shown at cover, Cover.

The pad means, Pad are designed to be placed inside the cars and the connection means allows the resilient straps to be disconnected and connected.

Figure 10:
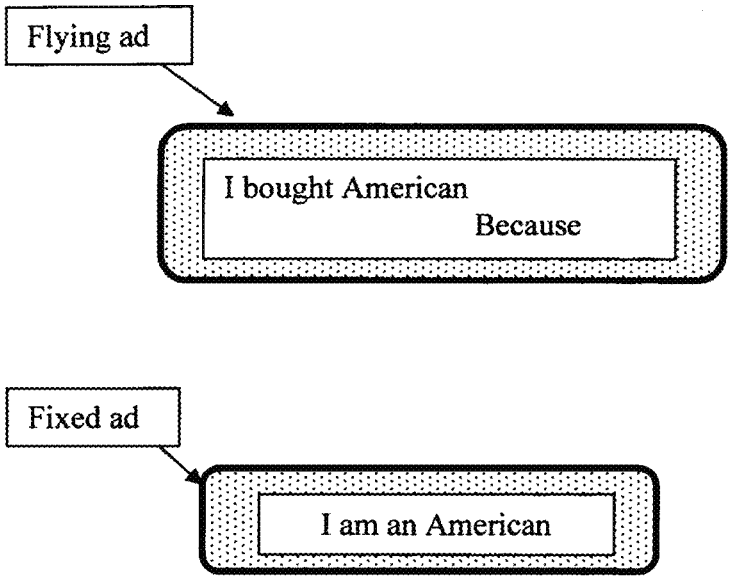
FIG. 10. Shows a method which allows two information sheets to be shown in one car.

FIG. 10. Shows a method which allows two information sheets to be shown in one car. In this method the user has one ad placed on the top of trunk edge near the window of the car and another one in the lower opening of the trunk of the car, near the bumper. This allows the user to show one information on the top and the second information in the bottom, and both of them to fly.

Example the first information may show.

I bought American.

The second information to show.

Because. I live in America.

Also by showing two ad at one time, by having two information, which one of them will fly and the second one to be attached or adhered to the body of the car. In this method the user has one ad which will fly and show its information and second ad sticked or adhered to the number stick. So that two information may be seen. In some models the first information may obscured the second information when it drops down after flying.

Example the first information attached to the number or body of the car which show.

I bought American.

The second information that flies will show.

Because. I live in America.

Figure 11:
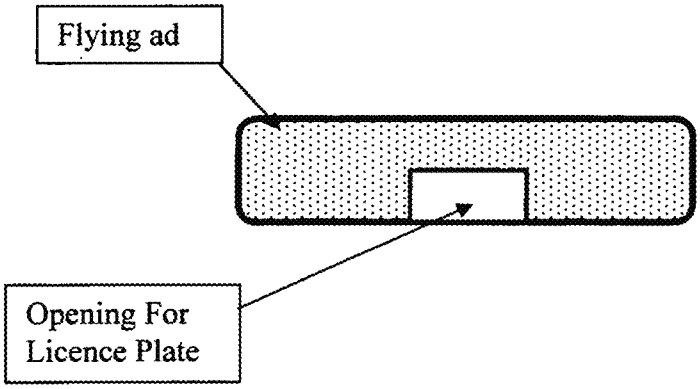
FIG. 11. Shows model which has opening for the license plate and lights of the cars, so that the information sheet will not cover those and prevent them from being obscured.

FIG. 11. Shows model which has opening for the license plate and lights of the cars, so that the information sheet will not cover those and prevent them from being obscured.

Figure 12:
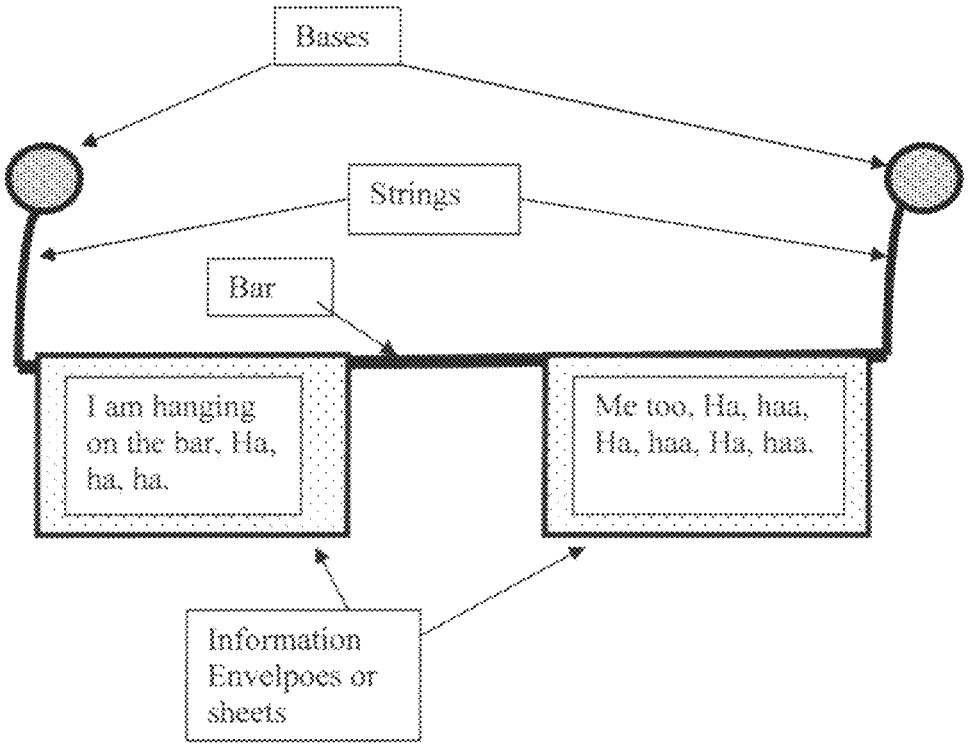
FIG. 12. Shows another model of advertising means that is also designed to spare the areas for the license plate and lights of the cars.

FIG. 12. Shows another model of advertising means that is also designed to spare the areas for the license plate and lights of the cars. In this model a bar, Bar allows the envelopes of information sheet to slide and hang on it, so that the information envelopes, or sheets may move from side to side on the bar allowing an space to be created in a desired spot. In this model only two envelopes of information are shown however they are not limited to two. The bar, Bar has string means that allows it to be attached to the car as explained in the text. The bases, Base will stand inside the car as explained as well.

DETAILED EXPLANATION THE INVENTION

Advertising is an important part of communication in the Society. People wish to inform the others about the information that they have. At present many techniques are used in order to reach this goal, one of such methods is to place the information on the top of the cars or to attached to the cars. However, these methods have significant drawbacks for example the attached units can not be exchanged easily. The printing material are expensive. The adhering of the information to the cars by using bumper sticks also have problems since they can not be exchanged easily when wanted, since the removal process is hard, time consuming and impractical. Also posting the information to the top of a car by a none moving method has the problem of creating resistance against the moving car, which causes loss of energy. Thus a method which eliminates or reduces these problems will be beneficial. To achieve such as goal this application introduces means for presentation of advertisement by making them in a sheet and allowing them to be flown like a kite. The sheet of information will be flat as shown in FIG. 1. It has a fabric type or a relatively rigid body which can be flown on the air. It has appropriate size to match the size of the back of the car. The sheet of information can be attached to the car by use of string or strap means, as shown at FIG. 1. This figure shows a flat piece, designed for having the advertisement printed on it. This sheet may be made from a fabric, a flexible or a rigid material. This flat piece has means of attachment to a series of strings, or the strap means. In this model the piece has holes shown at Hole that allows the strap or the string means to go through and to make it ready for being hanged. The flat piece also has a series of ornaments, Ornament attached to it, so that when this flat piece is airborne the ornaments can fly and makes the unit, more interesting. These ornaments can be.

A. Pieces of straps of various colors, or straps made with the colors of the flag of the America or other countries.

B. They can be pieces of rotating objects which will rotate when they are airborne.

C. They may have any other designs or shapes and purposes.

D. May have lights.

The ornaments will be attached to the main body of the flat piece or they may be attached to the strings and straps or to the car itself.

A simple prototype of this unit is shown at FIG. 2. This figure shows a flat piece similar to the unit shown at FIG. 1 except this figure also shows the string means and does not show the ornaments. This unit consists of.

IV. A flat piece, shown at, Sheet of information which has proper shape and size and has the advertising material printed on it, so that it can be viewed. This piece may be made from fabrics or a flexible or a rigid materials of various nature. This flat piece is attached to the strap means, Straps by use of means of attachment. In this model the piece has holes shown at Hole that allows a strap or the string means to go through it and be tied or snapped in order to make it ready to be hanged. The flat piece may have a series of ornaments attached to it as shown in FIG. 1, so that during the period of time that this piece is airborne they can fly and makes the unit, more interesting and visible.

V. The straps are also attached to a pad means, Pads which are simple pieces that will be kept inside the trunk of the car by various means and thus will prevent the straps from being pulled away. Commonly these will be placed inside the trunk of the car or through the rear doors or windows of the CRV's, station wagons and other autos and the doors or windows will be shot closed.

VI. The strap means, shown at straps, have a law profile or least thickness with the needed strength in order to be able to keep the flat piece from being pulled away from the car. They will be resilient so that with the lowest thickness they will be able to endure the pulling and tearing forces and not to breake or tear off. Their thin body will allow them to stand between the body of the car and the closed doors or the closed door of the trunk without creating problem.

The string or strap means will be attached to the sheet of information by,

1. Stapling.
2. Gluing.
3. By passing a string means or strap through holes in the in the sheet of information and being tied or snapped.
4. Or by any other means.

Importantly, the information piece may not be limited to a flat sheet since it may be made to have any shape that the user wishes to utilize and can be.

1. Shaped to be irregular.
2. To be in shape of prism.
3. To be in shape of cylinder.
4. To be in shape of statute.
5. To have various three dimensional shapes as different as anyone can imagine. Thus a user may wish to use differently shaped units with information to be flown. Preferably the inside of the unit to be hollow to fly easily.

Importantly, the string, or the strap means are designed to be long enough to allow the flat piece to be airborne but short enough and to prevent them from falling to the ground or to be simply too long and inconvenient.

By placing the pads and the ends of the strap means inside the trunk or body of the car the advertising piece could be kept in place sturdy without allowing them to be freed when airborne. Thus this unit provides significant versatility.

Another version of these models may be seen at FIG. 3. This figure shows a method in which a unit similar to one shown at FIG. 2 can be unutilized in slightly different fashion by using a longer strap means so that it can go through the lower holes of the unit and then to wrap around a part, a portion or a section of the vehicle such as the door of the trunk and or a one section of the sections of the rear door of a truck, then by an attachment means in its end to attach to the base part of the strap, here made from Velcro, Tm pads. So that this will keep the information sheet securely on the door of the trunk or section of a sectional door and prevent it from moving. The lower end of this straps means have a matching velcro means that attaches to the base. It should be considered that these attachment can be done by various attachment means. These units maybe placed in the sectional doors of trucks to allow the information be seen. Importantly, in some models the information piece may have attachment means to attach to different parts of the strap means itself in any spot. This model can be made by making the strap from the Velcro loop and the attachment means on the information piece from the velcro hook, so that these may be attached in any spot detachably. This model also shows that in some models the information sheet may be fixed to the autos.

FIG. 4. Shows even more options in this invention. In this figure the information means has body of a cylinder attached to strings in the center of its ends and it has pieces that can be placed inside a car to secure the strings so that the information means can be flown. Importantly, the cylinder may rotate around the end of the strap attachment spot, in order to allow different surfaces of the cylinder to be viewed. This figure is chosen to show that the information means may have different and even tri-dimensional shape and make up, thus it can be like a prism or any other shape and body. This gives more options to the users.

FIG. 5. Shows an example of other three dimensional unit for this use. This figure shows a cross cut of a sign unit with three surfaces, this unit is like a long, triangular prism. Thus beside the two triangular end sides it has three rectangular surfaces here shown as the surfaces, A, B and C. The unit will have strings attached to it in its base or corners. Thus by this method it allows.

A. The surface A to show the information when the car stops.
B. Surface B shows the information when the car is in move.
C. Surface C can be also shown when the user decides by flipping the sign.

Thus the idea and method of changing the signs and using different signs are shown in this figure. Importantly, The sign may be made to rotate by hand or various mechanical means. In some models of this unit shown in other figures, the main part is made from an envelope means, as shown in FIG. 6. This figure shows an alternative means of presenting the information by this invention. In this model an envelope means, 1 is used for placement of the information. This envelope means allows an information sheet to be exchanged easily by placing a sheet of information inside this envelope. This envelope consist of a flat Double-sided envelope means which has two walls attached to each other in their external borders for making such an envelope or a rectangular pocket. Importantly, at least one wall of this envelope will be transparent so that the information which is placed inside the envelope could be visualized from outside. The main body of the envelope may have further deviding walls, one of them shown at 3 which so that they divided the main body of the envelope to multiple spaces for placement of multiple special sized sheets of information. In this model there is 3 of such spaces present. This model is designed so that each space takes one page standard size paper of 11*8.5 inches, so that the information can be printed easily using the computer and regular printers and to be placed inside these spaces, so that a larger advertise can be made with use of three pieces of regular sheets of papers to make it easy and affordable. Importantly, this method allows the information sheets to be changed easily. In the lower side of this figure there is a line of opening or a cut, shown at 4 that allows the sheets of information to placed inside these pockets. This part may have a cover of its own (shown at FIG. 7) to prevent from dirt and rain to move inside. This envelope will be also attached to the car by strings means attached to it via use of various means explained in this application.

FIG. 7. Shows a modified version of the pocket means shown at FIG. 6. Except in this model the pocket means, Pocket is shown with no dividing walls in it, to prevent from a busy figure, however, there is a cover means shown at Cover that is hinged to the body of one of the walls of envelope (can be front or the back) so that this cover will cover the opening, Opening of the envelope and prevent it from the dirt and rain or similar to move inside. The hinge is shown at Hinge. This envelope will be attached to the car by strings means attached to it or via use of various means explained in this application. Also in this model the attachment means, Attachment means are shown that can be holes or snaps that allows the unit to be attached to the car securely utilizing the attachment means or the string means, or similar. Thus the envelopes allows a sheet of information to be placed inside it and displayed by F. By flying it as a kite, hanged form windows.
G. By flying it like a kite from rear by holding the string means in the trunk of the car.
H. By attaching it to the top of the car by use of bases.
I. Importantly, this method even allows them to be taken out and be placed on a post/s on the ground.
J. The pocket means may have attachment means or be adhered to the body of the vehicle in order to allow the information sheet to be changed. This will provide significant advantage that the pocket means would not need to be changed but the information can be changed at will. This model can be even adhered to the bomber of the vehicles.

FIG. 8. Shows a modified version of this invention which basically consists of the following.

4. A securing means shown at Base, designed for placement inside the body of the car or inside the trunk for preventing from the release of an attached strings or straps means, shown at Resilient Strap, so that the securing means when in place, can not be pulled away from the space which they are designed to stay. For example, the securing base can be placed inside the trunk of the car so that when the door of the trunk is closed the rest of the string will be out of the trunk and the securing means will not allow the string means to be poled away from the trunk. Or the base, Base may be placed inside the windows again for preventing the string to be pulled away from inside the car. In some models securing base may be attached to the window or placed, outside of the window in order to allow the flat piece to be hanged inside the window.

Securing means, can be

I. A. pad means. Which will stay inside the vehicle or in one side of the body of the vehicle and prevent the string means to be pulled out.

II. A clamp means to clamp to matching part in one side of the body of the vehicle and prevent from the string means being pulled out.

III. A clip means in order to clip to a matching part in one side of the body of the vehicle to prevent from the string means being pulled out.

IV. Piece of wood, plastic or similar, means, big enough not to be pulled via the opening of a closed door or trunk of a car.

V. A heavy object to be placed inside the one side of, the body of the vehicle to prevent from the string means being pulled out.

VI. Shaped pieces, may be attached, on removable Re: attachable basis 2 parts of the trunk or body of the ventricle.

VII. Various attachments means, such as being tied to the hinge means or related parts of the door of the car, or parts of the car in order to prevent the string to be pulled away.

VIII. Screwing means.

IX. Adhesive means.

X. Magnetic means.

XI. Attachment to the spare tires or their bases.

XII. Or any other means that can possibly be used for securing the string, or straps in or outside of the car for this purpose.

Thus the base means is to hold a resilient strings or strap means from moving from one side of the window or inside of the trunk or any other part of the car. Whether closed or open.

5. A resilient strings or strap means, Resilient Strap which would be connected to the envelope, and keeps the envelope from being flown away. The attachment of this drug means to the body of the pocket or designed can be of many kind such as.

a. It may have a clip in order to to through the hole and prevent from the string means to be pulled out of the hole.

b. To be a clamp means, in the other side of the hole of the pockets means in order to prevent from the string means being pulled out and also to allow the length of the string means to be adjusted to shorten or lengthen.

c. The attachment spot of the string means to the pockets means may allow it to be disconnected from the pocket means at will.

d. The attachment point of the string means to the pockets means may allow the pockets means to rotate and allow the different faces of the pockets means to be shown.

Importantly, the string means may have extra pieces or extension is in order to allow the pockets means to be hold sturdy in one position compared to body of the car or door of the trunk or similar. This may be needed in some cases which flying will not be best due to certain circumstances such as severe winds etc.

6. A resilient strings or strap means, Resilient Strap which would be connected to the envelope, and keeps the envelope from being flown away.

7. An envelope means, here shown at Pocket which consist of a flat Double-sided envelope which has two walls attached, to each other in their borders to make such an and envelope or rectangular pocket. Which at least one wall of it would be transparent so that the information placed inside the envelope could be visualized from outside. Importantly, both sides of the envelope may be transparent so that it can be filliped to allow the second surface to be viewed to allow option of viewing different ads. This envelope will be, attached to a resilient string or strap which would be hold securely by placing inside the car, or even outside of the car by being attached to the car. This pocket means allows a sheet of written material a photo or similar means to be placed inside it, here shown at The massage. One side of this pocket means may have a bar means, shown at Bar which is a bar with a calculated weight in order to make the envelope to fell down after it was air born and when the car stops. A connection means, shown at Connection means allows the resilient strap, Resilient strap to be disconnected and connected from each other in order to remove the pocket, Pocket when there is a need for such connection, for exchange, storage or any other means. This is important since in some cases the user may wish to remove the ad and store to prevent from damage being stolen or in order to change the information inside. Thus the use of connection means allows this process to be simple.

FIG. 9. Shows a modified version of the unit shown at previous FIG. 8. Except this unit has two strap means shown at Resilient Straps with the connection means, Connection Means, attached to them and a rather long pocket, Pocket with its sealed borders shown at Border, and the cover for opening shown at cover, Cover.

The pad means, Pad are designed to be placed inside the car or the car trunk and the connection means allows the resilient straps to be disconnected and connected.

Importantly, the body of the pocket may have walls attached to it in various spots or lines and in different angulations in order to function as a wing for keeping the unit in special position while is flying.

The end of the pocket may have a flat wall attached to it vertically in order to show the information while the unit is airborn.

Other important features.

A. This unit can be further intensified by use of methods that allow the information sheet to rotate and shows its different surfaces in different times. This allows one information to be shown one time and to show the next information next, so that the observer will see two or more different information. This allows not only long information to be displayed but also to make the person curious for noting the next information after noting the first one. Example.

the first information may show.

I bought American.

The second information to show.

Because. I Am american.

B. By showing two ad at one time, by having two information as shown in FIG. 10. In this method the user has one ad placed on the top of trunk edge near the window of the car and another one in the lower opening of the trunk of the car, near the bumper. This allows the user to show one information on the top and the second information in the bottom, and both of them to fly.

Example the first information may show.

I bought American.

The second information to show.

Because. I live in America.

C. By showing two ad at one time, by having two information, which one of them will fly and the second one to be attached or adhered to the body of the car. In this method the user has one ad which will fly and show its information and the second ad sticked or adhered to the bumper stick. So that two information may be seen. In some models the first information may obscure the second information when it drops down after flying. Example the first information attached to the bumper or body of the car which show.

I bought American.

The second information that flies will show.

Because. I live in America.

So that when the car is moving the observer will see the attached sign saying,

I bought American. Then when the car stops

The second information that was flying will show.

Because. I live in America. Or in different sequence as chosen.

Thus many theses methods and many versions of these ads may be used in order to bring an important massage to the observer.

Importantly, special attention will be paid to spare the areas for the license plate and lights of the cars, so that the information sheet will have proper opening in those areas to spare those from being obscured. Such a model is shown at FIG. 11, which there is opening that falls on the license plate. A similar opening may be designed for the lights as needed.

FIG. 12. Shows another model of advertising means that is also designed to spare the areas for the license plate and lights of the cars. In this model a bar, Bar allows the envelopes of information sheet to slide and hang on it, so that the information envelopes, or sheets may move from side to side on the bar allowing an space to be created in a desired spot. In this model only two envelopes of information are shown, however they are not limited to two. The bar, Bar has string means that allows it to be attached to the car as explained in the text. The bases, Base will stand inside the car as explained as well.

Importantly, the shape, size the colors, relative sizes and different combinations of these units may be chosen to make other units for different uses.

The invention claimed is:

1. An advertising device for a motor vehicle having a compartment and a movable member for opening and closing the compartment to the exterior of the motor vehicle, the advertising device comprising: an advertising display on the exterior of the motor vehicle containing printed matter; and strap means extending from the advertising display for tethering the advertising display on the motor vehicle, the strap means having a part which is placed inside the compartment while the movable member opens the interior space and a strap for extending from the part out of the compartment between an edge of the member and an edge of the compartment when the member is closing the compartment, the part inside the compartment having a size which prevents it from being pulled out of the compartment by pulling on the strap while the member is closing the compartment; in which the advertising display comprises an upper hole and a lower hole, and the strap is attached to the advertising display and the movable member by extending from the part inside the compartment, passing through the upper hole, passing through the lower hole, and extending between the edge of the movable member and the edge of the compartment back into the compartment to attach to the strap means in encirclement of the movable member.

2. An advertising device as set forth in claim 1 in which the strap has a length which allows the advertising display to become airborne when the motor vehicle is in motion but which prevents the advertising display from falling to the ground when the motor vehicle is not in motion.

3. An advertising device as set forth in claim 1 in which the length of the strap between the part and the advertising display can be adjusted by the location at which an attachment means on the strap attaches to an attachment means on the advertising display.

4. An advertising device as set forth in claim 3 in which the attachment means on the strap comprises one of hook fastener material and loop fastener material and the attachment means on the advertising display comprises the other of hook fastener material and loop fastener material.

5. An advertising device as set forth in claim 1 including at least one ornament attached to the advertising display.

6. An advertising device as set forth in claim 1 in which the advertising display comprises a hole, and the strap is attached to the advertising display by passing through the hole and attaching to itself.

7. An advertising device as set forth in claim 6 in which the strap attaches to itself by hook attachment material at one location on the strap and loop attachment material at another location on the strap.

8. An advertising device as set forth in claim 1 in which the strap attaches to the part inside the compartment by hook fastener material attaching to loop fastener material.

9. An advertising device as set forth in claim 1 in which the strap means allows the advertising display to hang from the motor vehicle when the motor vehicle is not in motion and to become airborne when the motor vehicle is in motion.

10. An advertising device as set forth in claim 9 in which the advertising display comprises a first display area containing printed matter which can be viewed at a distance from the motor vehicle when the motor vehicle is not in motion and the advertising display is hanging from the motor vehicle, and a second display area containing printed matter which cannot be viewed simultaneously with the first display area at a distance from the motor vehicle when the motor vehicle is not in motion and the advertising display is hanging from the motor vehicle, and in which the second display area can be viewed at a distance from the motor vehicle when the motor vehicle is in motion and the first display area cannot be viewed simultaneously with the second display area at a distance from the motor vehicle when the motor vehicle is in motion and the advertising display has become airborne.

11. An advertising device as set forth in claim 1 in which the strap means comprises two straps which attach to the advertising display at horizontally spaced apart locations.

12. An advertising device as set forth in claim 1 in which the strap means comprises a connection for disconnecting the advertising display from the motor vehicle while leaving a portion of the strap means on the motor vehicle.

13. An advertising device as set forth in claim 1 in which the advertising display is disposed over the rear exterior of the motor vehicle; the advertising display having at least one opening which allows a lamp or license plate on the rear of the motor vehicle to be viewed simultaneously with the printed matter from a distance to the rear of the motor vehicle.

14. An advertising device as set forth in claim 13 in which the at least one opening comprises a cut-out centrally located along a bottom edge of the advertising display.

* * * * *